United States Patent [19]

Tinnes

[11] Patent Number: 4,708,193

[45] Date of Patent: Nov. 24, 1987

[54] PROCESS FOR REMOVING DEPOSITS FROM THE FLOW CHANNEL OF A TUNDISH DURING CONTINUOUS CASTING

[75] Inventor: Bernhard Tinnes, Zollikerberg, Fed. Rep. of Germany

[73] Assignee: Metacon AG, Zurich, Switzerland

[21] Appl. No.: 899,295

[22] Filed: Aug. 20, 1986

Related U.S. Application Data

[63] Continuation of Ser. No. 746,847, Jun. 20, 1985, abandoned.

[30] Foreign Application Priority Data

Jun. 20, 1984 [DE] Fed. Rep. of Germany ..... 3422901

[51] Int. Cl.[4] ..... B22D 11/18

[52] U.S. Cl. ..... 164/453; 164/454; 222/591

[58] Field of Search ..... 164/453, 454, 488, 449, 164/337, 489, 451, 452, 437; 222/590, 591, 600, 606, 594

[56] References Cited

U.S. PATENT DOCUMENTS 3,946,795 3/1976 Bruderer ..... 164/449

FOREIGN PATENT DOCUMENTS 55-54249 4/1980 Japan ..... 164/449
55-141366 11/1980 Japan ..... 164/453
869946 10/1981 U.S.S.R. ..... 164/449

OTHER PUBLICATIONS

"Tundish Nozzle Blockage in Continuous Casting", by G. C. Duderstadt et al.

I. Depierreux et al., "Tundish Slidegate Valve", Concast Convention, 1984, pp. 1–23.

Bernhard Knell, "Tundish Slidegates on Multistrand Continuous Casting Machines", Edition 1984/85, pp. 83–86.

Bernhard Tinnes, "Meeting on Continuous Casting", Duisburg/Germany in 1984, Extract from Proceedings, pp. 1–22.

*Primary Examiner*—Nicholas P. Godici
*Assistant Examiner*—G. M. Reid
*Attorney, Agent, or Firm*—Wenderoth, Lind & Ponack

[57] ABSTRACT

During continuous casting, in order to avoid a cessation of the casting operation which is caused by a narrowing of the flow channel of a tundish equipped with a sliding gate, two processes are utilized. A first process enables an automatic rinsing so as to flush away any obstructions causing the narrowing, and, if the rinsing process is unsuccessful, a second process is effected in which the obstructions are manually removed by an operator.

3 Claims, 2 Drawing Figures

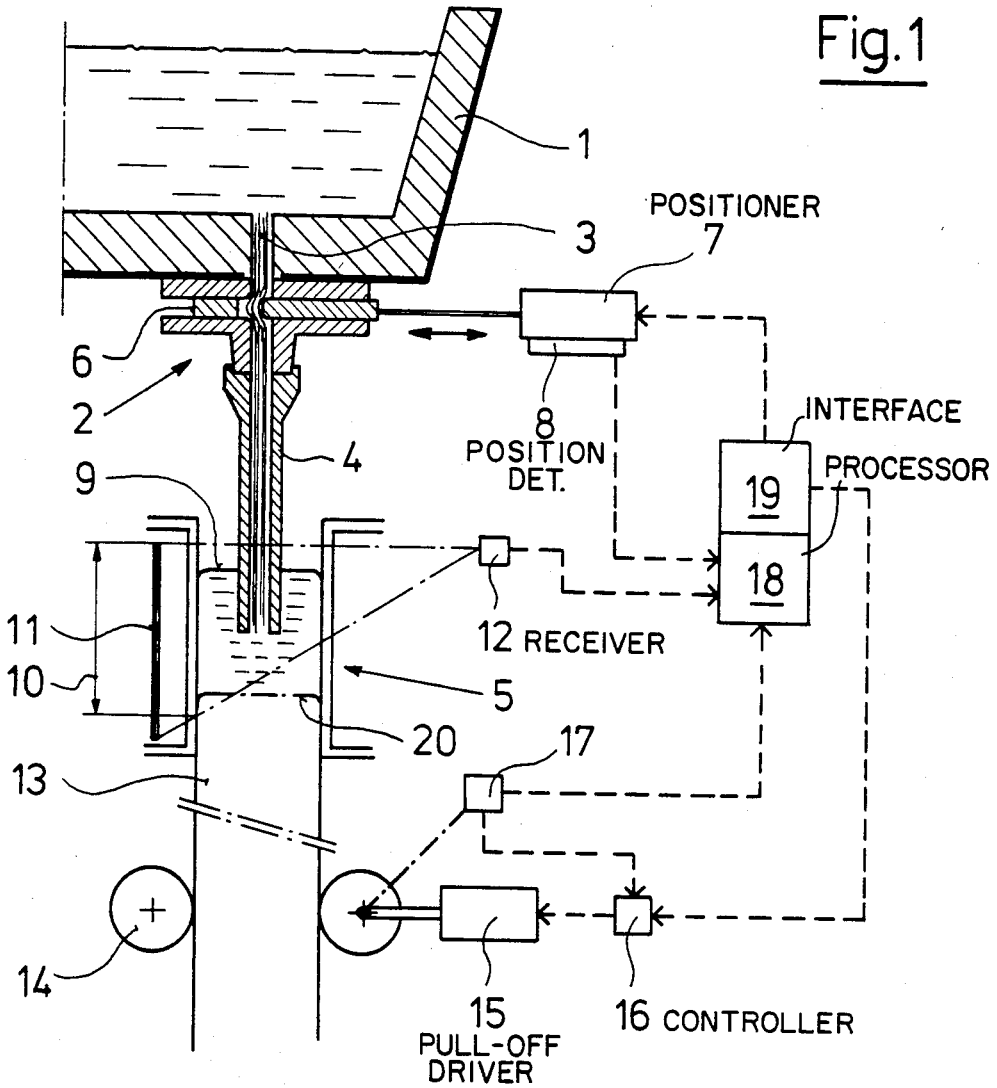
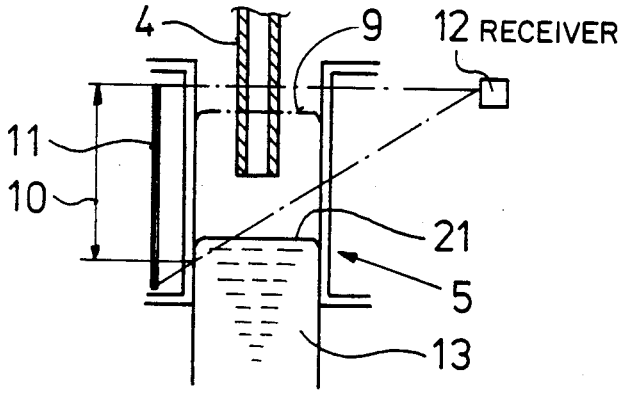
Fig.2

PROCESS FOR REMOVING DEPOSITS FROM THE FLOW CHANNEL OF A TUNDISH DURING CONTINUOUS CASTING

This application is a continuation of now abandoned application Ser. No. 746,847, filed June 20, 1985.

BACKGROUND OF THE INVENTION

The present invention relates to a process for casting a metallic melt into a continuous casting mold.

When casting a steel melt, for example, from a tundish or a distributor into a continuous casting mold, it is a common practice to use a sliding closure unit or slide gate as a controlled valve for controlling the quantity of melt discharged per unit of time. In this case, the slide gate normally operates in a variable throttling position, that is, in a position throttled over half of the possible full opening so as to enable it to follow the opening and closing commands that emanate—in the case of an automatic control of an adjusted set level of the melt in the ingot mold—from a control system which obtains data from a sender and receiver used to detect the melt level in the mold. A constant pull-off rate is established so as to improve the strand quality of the cast steel. In this case, it may come to pass that an imbalance occurs between the quantity of melt being discharged from the tundish and the strand stock emerging from the ingot mold that can no longer be compensated for by the slide gate. This is attributable to a narrowing of the opening of the flow channel.

Such a narrowing of the opening can occur, for example, during the casting of aluminum-killed steels, wherein aluminum oxide is deposited in the flow channel, mainly on the throttling edges of the movable plate of slide gate, thereby clogging the opening thereof. Likewise, the flow channel can be clogged by the freezing of the melt when the channel wall has not yet been heated adequately in the initial phase of the casting process. Heretofore, such a narrowing of the opening that is building up has been compensated for by appropriately opening the movable plate of the slide gate until it reaches its fully open position and, optionally, by reducing the pull-off rate of the cast strand to a lower limit that is still acceptable from the metallurgical point of view. Thereafter, it is necessary to terminate the casting operation, which can lead to considerable difficulties and costs.

SUMMARY OF THE INVENTION

The primary object of the invention is to overcome, by simple techniques, a narrowing occurring in the flow channel of the tundish and slide gate in a first processing step without changing the casting rate and, if this first processing step is not successful, in a second processing step without terminating the casting operation.

In most cases, this object of the basic removal of a narrowing is achieved by the novel processing steps including providing a powerful rinsing stream which is produced during the opening of a slide gate. This rinsing stream washes the flow channel free of deposits, frozen melt, etc., and restores the casting conditions necessary for the particular plant, during which the pull-off rate of the strand, and thereby the metallurgical nature thereof, have remained unchanged and which, moreover, prevents a dangerous spilling of the melt over the ingot mold rim by the provision of a free space provided in the ingot mold by the processing steps.

If, against all expectations, the flow channel cannot be rinsed free with the processing steps as noted above, then a second, novel process can be initiated, as needed, with additional processing steps. The conditions required for the casting operation can rapidly be restored by manually removing deposits, frozen melt, etc., from the flow channel by introducing tools, for example, an oxygen lance used for burning out the tap hole, into the vessel-side end of the flow channel. However, bringing the movable plate into its fully open position requires that the refractory wearing material not be exposed to damage, especially the bottom plate and the movable plate.

Overall, the process, as recited in the appended claims, serves to prevent a definitive cessation of the casting operation, which would result in costly and complex production losses.

BRIEF DESCRIPTION OF THE DRAWINGS

The invention will now be discussed with reference to the accompanying drawings, in which:

FIG. 1 is a diagram of an apparatus used for carrying out the process in accordance with the present invention and with a movable plate of a slide gate in the throttled operating position and with the ingot mold at the desired level required for normal operation.

FIG. 2 shows a partial view of an ingot mold having a lowered desired level.

DESCRIPTION OF THE PREFERRED EMBODIMENT

Element 1 in FIG. 1 is a tundish containing a metallic melt, with which is associated a slide gate 2 used for controlling the quantity of melt discharged from the vessel through a common flow channel 3 via a casting tube 4 into an ingot mold 5. To this end, an adjustable damper or movable plate 6 is coupled by mechanical means to a positioner 7, whose particular operating position is detected a position detector 8. The positioner 7 may consist of a commercially available double-acting hydraulic cylinder actuator while the detector 8 may consist of a commercially available linear variable differential transformer whose output is indicative of the relative position of the actuator constituting the positioner 7. The free end of the casting tube 4 extends into the ingot mold 5, whose desired level 9, is set for normal operation at about 80 percent of a measuring section 10 of a level indicator consisting of a sender 11 and a receiver 12. The sender 11 may consist of a commercially available gamma ray rod source and the receiver 12 may consist of a commercially available scintillation counter. In fact, the gamma ray source and scintillation counter together correspond to a standard mold level gauge presently used in prior art continuous casting systems. The cast strand 13 is pulled off by means of a pull-off driver 15 having a cylindrical drive roller 14 and a speed controller 16. The driver 15 and controller 16 may consist of a commercially available variable speed motor and its speed controller. Furthermore, the driver 15 has a pull-off-tachometer 17 which transmits an output signal to the controller 16 and to a processor 18, which also receives and processes a data signal from the position detector 8 and the receiver 12. An interface unit 19, which is integrated with the processor 18, then transmits appropriate control commands to the positioner 7 of the slide gate 2 and to the controller 16. The interface 19 may include a commercially available hydraulic servo valve for controlling the hydraulic actuator of the positioner 7 and may further include a commercially available line driver for providing appropriate electrical signals for the controller 16.

Since the pull-off rate for a normal casting operation is established as a constant, the desired level 9 of the melt in the ingot mold 5 is adjusted only from the supply side, that is, from the tundish side, by means of the slide gate 2. To accomplish this, the movable plate 6 assumes a throttling position which enables it to control the opening and closing of the slide gate 2 so as to maintain the balance between the incoming quantity of melt and the strand stock emerging from the ingot mold 5. On one hand, the movable plate 6 moves to close the gate 2 so as to reduce the flow, for example, after the opening thereof has been enlarged by wear and, on the other hand, the movable plate 6 moves to open the gate 2 so as to increase the flow as soon as the opening thereof has been narrowed, for example, by deposits of oxides or frozen metal. Such a narrowing of the opening leads to problems, because the opening movement of the slide gate 2 is limited to its fully open aperture, so that the quantity of melt called for the by level indicator can no longer be supplied through the narrowed opening.

Now, in order to avoid a lowering of the pull-off rate needed in this case, the processor 18 and interface 19 control the position of the movable plate of the slide gate 2 when the aperture ratio, that is, the ratio of the actual aperture of the gate 2 to its fully open aperture, beyond the normal throttling position in the direction of its closing reaches 90 percent so that an actual level results with a free space for the desired level. For example, if the actual level has reached the height 20 at the measuring section 10, the positioner 7 receives a command to completely open the slide gate 2 so as to enable the melt to gush out of the flow channel 3, thereby hopefully freeing the channel 3 of the obstructions causing its narrowing. The oversupply of melt thus reaching the ingot mold 5 fills the mold and its deliberately produced free space and raises the actual melt level to the desired level 9, thereby initiating the normal casting operation.

As illustrated in FIG. 2, during a further process which follows immediately in the event that the rinsing process described above is not successful, a change of the pull-off rate must be tolerated so as to avoid a complete stoppage. However, the desired level 9 at the testing section 10, as controlled by the processor 18, must be set to a lower level 21. This means that the actual level drops to this new level 21 and a larger free space results up to the upper edge of the ingot mold. As soon as the actual level coincides with the new desired level, the processor 18 supplies a signal through the interface 19 to the positioner 7 which moves the slide gate 2 and simultaneously supplies a signal to the pull-off controller 16. The slide gate 2 is then released and is ready to move to a totally open position so as to enable the flow channel 3 to be manually burned free by an operator, for example, with an oxygen lance inserted from the side of the vessel. The quantity of melt freed suddenly pours into the larger ingot free space produced by the lowering of the desired level 9 to the level 21 until the actual level rises, thereby causing the restoration of the desired level 9.

We claim:

1. In a process for pouring a metallic melt from a metallurgical vessel into a continuous casting mold having a pull-off driver for pulling off the cast strand via a flow channel and a controlled valve having a variable aperture, comprising the steps of:

measuring the level of melt in the casting mold;

measuring the aperture of the controlled valve;

measuring the pull-off rate of the cast strand leaving the casting mold;

an improved process for removing obstructions from the flow channel which narrow the flow channel while continuing the pouring of the melt into the mold wherein, when the narrowing in the flow channel is detected on the basis of the measured value of the aperture increasing to a predetermined value, a throttling operation is first effected by controlling the valve so as to reduce the aperture in the valve and thereby lower the level of melt in the mold and then, when the level of the melt in the mold reaches a predetermined lower level, a widening the aperture of the valve to its maximum value is effected so as to cause a surge of metallic melt to flow through the flow channel and thereby remove the obstructions therefrom until such time that the level of the melt in the mold reaches a predetermined upper value and then the aperture of said valve is controlled so as to maintain the level of melt in the mold at the upper value.

2. A process as recited in claim 1, wherein said throttling of said valve is initiated no later than when the ratio of the measured aperture of said valve to its maximum value is 90 percent.

3. A process as recited in claim 1, further comprising the subsequent steps of:

controlling the aperture of the valve so as to lower the level of the melt in the mold to a predetermined low value;

controlling the pull-off driver so as to reduce the pull-off rate of the cast strand to a predetermined low value;

widening the aperture of the valve to its maximum value so as to thereby enable the flow channel to be manually freed of obstructions by an operator;

and then controlling the aperture of the valve so as to raise the level of the melt in the mold to the predetermined upper level and then adjusting the pull-off driver so as to increase the pull-off rate to a predetermined value.

* * * * *